US010615539B1

(12) United States Patent
Vanzo

(10) Patent No.: US 10,615,539 B1
(45) Date of Patent: Apr. 7, 2020

(54) CONNECTION SYSTEM WITH A BAYONET-TYPE LOCKING DEVICE ADAPTED TO ALLOW A QUICK DISCONNECTING OPERATION

(71) Applicant: RADIALL, Aubervilliers (FR)

(72) Inventor: Augusto Vanzo, Milan (IT)

(73) Assignee: RADIALL, Aubervilliers (FR)

( * ) Notice: Subject to any disclaimer, the term of this patent is extended or adjusted under 35 U.S.C. 154(b) by 58 days.

(21) Appl. No.: 16/089,597

(22) PCT Filed: Apr. 4, 2016

(86) PCT No.: PCT/IT2016/000081
§ 371 (c)(1),
(2) Date: Sep. 28, 2018

(87) PCT Pub. No.: WO2017/175248
PCT Pub. Date: Oct. 12, 2017

(51) Int. Cl.
*H01R 13/62* (2006.01)
*H01R 13/213* (2006.01)
(Continued)

(52) U.S. Cl.
CPC ..... *H01R 13/625* (2013.01); *H01R 13/633* (2013.01)

(58) Field of Classification Search
CPC ..... H01R 13/625; H01R 13/6335; H01R 2103/00; H01R 23/661; H02G 3/20; F21V 21/02
(Continued)

(56) References Cited

U.S. PATENT DOCUMENTS 3,328,743 A * 6/1967 Acord ..... H01R 13/635 439/258
3,430,184 A * 2/1969 Acord ..... H01R 13/6335 439/255
(Continued)

FOREIGN PATENT DOCUMENTS

GB 2105923 A 3/1983
GB 2382733 A 6/2003

OTHER PUBLICATIONS

Corresponding International Application, Application No. PCT/IT2016/000081, International Search Report, dated Dec. 1, 2016, 2 pages.

*Primary Examiner* — Abdullah A Riyami
*Assistant Examiner* — Thang H Nguyen
(74) *Attorney, Agent, or Firm* — Cooper Legal Group, LLC; Ronald M. Kachmarik

(57) ABSTRACT

A connection system with two system elements forming a plug and a receptacle. A locking device including a locking nut mounted free in rotation around the plug or the receptacle, and a locking pin arranged into the locking nut. The locking pin is adapted to be engaged into a locking ramp provided in the receptacle or the plug by relative translation between the plug and the receptacle and rotation of the locking nut to mechanically lock the plug to the receptacle when they are in mutual connection. The arrangement of the locking pin is such that a pull force applied to a sliding part of the locking nut, in a sense opposite to the sense of their mutual connection, disengages the locking pin from the locking ramp, allowing the unlocking of the plug from the receptacle.

11 Claims, 4 Drawing Sheets

(51) Int. Cl.

| | |
|---|---|
| ***H01R 13/00*** | (2006.01) |
| ***H01R 13/28*** | (2006.01) |
| ***H01R 25/00*** | (2006.01) |
| ***H01R 13/64*** | (2006.01) |
| ***H01R 13/625*** | (2006.01) |
| ***H01R 13/633*** | (2006.01) |

(58) Field of Classification Search
USPC ..... 439/314, 286, 311, 337, 483, 923, 680
See application file for complete search history.

(56) References Cited

U.S. PATENT DOCUMENTS

| | | | | | |
|---|---|---|---|---|---|
| 3,452,316 | A * | 6/1969 | Mocek | H01R 13/637 | 439/255 |
| 4,307,924 | A * | 12/1981 | Gibbs | H01R 13/44 | 439/484 |
| 4,447,103 | A * | 5/1984 | Werth | H01R 13/5219 | 439/152 |
| 4,695,109 | A * | 9/1987 | Ratchford | H01R 13/62 | 439/155 |
| 4,702,537 | A * | 10/1987 | Mattingly | H01R 13/625 | 439/152 |
| 4,778,400 | A * | 10/1988 | Jacobs | H01R 13/631 | 439/152 |
| 7,097,490 | B2 * | 8/2006 | Eaton | H01R 13/633 | 439/350 |
| 9,570,848 | B1 * | 2/2017 | Suarez | B26B 19/3806 | |
| 2007/0111582 | A1 * | 5/2007 | Yoshinori | G02B 6/389 | 439/348 |
| 2014/0368069 | A1 * | 12/2014 | Ren | H01R 13/622 | 310/71 |

* cited by examiner

CONNECTION SYSTEM WITH A BAYONET-TYPE LOCKING DEVICE ADAPTED TO ALLOW A QUICK DISCONNECTING OPERATION

TECHNICAL FIELD

The present invention relates to a connection system comprising a plug and a receptacle, with a bayonet-type locking device suitable for mechanically locking the plug to the receptacle when they are in mutual connection configuration.

The applications particularly targeted by the invention are the electrical connection systems which can accommodate a plurality of independent contacts or connection modules of contacts, a number of 4 or 7 contacts, or modules of contacts, typically, which are electrical and/or optical depending on the electrical and/or optical connection to be achieved. More specifically, but not only, high current and/or a high electrical power can be transmitted by this type of systems.

The invention also relates generally to the connection systems in the outdoor applications, notably for railways and rolling vehicles and for aeronautic or military or robotics applications.

The invention more particularly aims to propose a connection system in which the bayonet-type locking device can be disconnected fast with the unique implementing of a pulling external force.

PRIOR ART

It is well-known, in the field of the electrical connections systems comprising a plug and a receptacle to be mutually connected, to provide them with a locking device which allows to mechanically lock the plug to the receptacle when they are in mutual connection.

Among the locking devices, the bayonet-type devices are widely spread because they are efficient and allow an easy and fast manual locking.

Thus, locking pins are engaged into locking helical ramps (slots) by rotating a part in an helical movement in a given sense, generally a clockwise sense.

For uncoupling the plug from the receptacle, it is necessary to rotate the part in a contrary sense.

However, this way of uncoupling of the connection system is not appropriate for the applications where a fast disconnection of the connection system is required, such as in case of emergency, with or without no human intervention.

For this purpose, it has already been proposed quick release mechanisms relying only on one axially applied external force. Besides, the needs of the users have dictated the use of a cable or a lanyard attached to the plug of the connection system to apply the axially directed external force for obtaining a quick disconnect.

The major drawbacks of the oldest quick disconnection systems were that the mechanism were of a complex design.

U.S. Pat. No. 4,702,537 patent discloses a mechanism for a quick disconnection compatible with a bayonet locking device. This mechanism requires a high precision to manufacture all the components and is complex to assemble with an important number of specific pieces, such as the ramp spring elements mounted into the first coupling ring, which increases the manufacturing costs.

There is therefore a need to further improve the connection systems comprising a bayonet-type locking device, in order to allow a fast and efficient disconnection between the plug and the receptacle, notably with a simple design and an easy assembly, and at reduced manufacturing costs.

The invention aims to address all or some of this need.

EXPLANATION OF THE INVENTION

The subject of the invention is thus a connection system, of longitudinal axis X, comprising:

a first system element forming a plug and a second system element forming a receptacle, a bayonet-type locking device comprising a locking nut mounted at least free in rotation around one of among the plug and the receptacle, at least one locking pin being arranged into the locking nut, said at least one locking pin being adapted to be engaged into a locking ramp provided in one of among the receptacle and the plug by translation and rotation of the locking nut so as to mechanically lock the plug to the receptacle when they are in mutual connection along the longitudinal axis X.

According to the invention, the arrangement of the said at least one locking pin being such that a pull force (P) applied to a sliding part of the locking nut, in a sense opposite to the sense of their mutual connection along the longitudinal axis X, disengages the said at least one locking pin from the locking ramp, thereby allowing the unlocking of the plug from the receptacle, then their mutual disconnection.

The expression "bayonet-type locking device" should be understood to mean a locking device that works by the cooperation of at least one pin (stud) with a ramp (slot) and which can be implemented manually without there being any need to use tools to increase the locking force by hand. Such a bayonet locking device is usually known generically as a rapid locking device.

Thus, the invention mainly consists in defining locking pin(s) which can be disengaged elastically from the corresponding locking ramp(s) under the unique effect of a pull outside force applied on a sliding part of the locking nut.

Unlike the disconnection mechanism according to U.S. Pat. No. 4,702,537 patent, the invention does not require intermediate elements, such as the peripheral ramp spring elements of said patent, to release the locking pins.

Therefore, the bayonet locking device according to the invention is more simple to manufacture and to assemble compared to the disconnection system according to U.S. Pat. No. 4,702,537 patent.

According to an advantageous variant, the cross-section of the lower portion of the at least one locking pin is of a truncated cone shape and is complementary to the truncated cone shape of the cross-section of the locking ramp.

Preferably, the connection system comprises three locking pins distributed at 120° relative to one another on the periphery of the locking nut, and the body of the one among the plug and the receptacle comprises three locking ramps of the same shape distributed at 120° relative to one another, any of the locking pins being suitable for cooperating with any of the ramps.

In the preferred embodiment, the locking nut comprises an internal shell and an external shell which is sliding mounted around the internal shell on a predetermined course, wherein the at least one locking pin is mounted into an opening of the internal shell and attached to the free end of the flexible strip, the other end of the flexible strip being attached to the internal shell, the external shell surrounding the at least one locking pin in their mutual connection and locking configuration.

In an advantageous variant, the system comprises at least one holding pin which is mounted into the internal shell, said holding pin being adapted to maintain each flexible strip along the longitudinal axis of the plug. The strip avoids any lateral movement of the locking pin during the application of the pull force according to the invention.

In another advantageous variant, the system comprises at least one spring forming element arranged between the internal shell and the external shell, said spring element being adapted to push the external shell back to its position surrounding the at least one locking pin, when no pull force is applied on said external shell. This spring element allows to push the external shell back to its position surrounding the at least one locking pin, when no pull force is applied on said external shell. The spring forming element may be preferably a compression helical spring, which is very efficient and allows a compact arrangement between the internal shell and the external shell.

According to an advantageous variant, the system comprises at least one an attachment flange which is attached to the sliding part of the locking nut, and a pull element attached to the attachment flange and arranged outside the locking nut in order to be accessible from the outside of the connection system. comprising two attachment flanges and a flexible pull element, such as a
cable, each end of which is attached to one attachment flange.

In a preferred embodiment, the locking nut is mounted free in rotation around the body of the plug, while the locking ramp(s) being provided at the periphery of the body of the receptacle.

For preferred applications, the system constitutes a connection system comprising a plug and a receptacle, each having an insert including a plurality of cells each forming a housing for an electrical or an optical contact or contacts module.

The invention concerns also a method of quick disconnecting the connection system mentioned above, comprising the following step:

applying a pull force backward on the external shell on a predetermined course making this latter sliding along the internal shell on the predetermined course, thereby allowing firstly the disengagement of the external shell from the top of the at least one locking pin, and after the disengagement of said pin from the locking ramp by the relative translation of the plug and the receptacle.

DETAILED DESCRIPTION

Other advantages and features of the invention will become more apparent on reading the detailed description of exemplary implementations of the invention, given as illustrative and non-limiting examples with reference to the following figures in which.

Hereinafter, the invention is described with reference to a connection system of a circular cross-section and with a bayonet-type rapid locking device by way of example and illustration.

This connection system is particularly intended for outdoor applications, notably for railways and rolling vehicles and for aeronautic or military applications.

This system can accommodate a plurality of independent contacts, or connection modules of contacts, a number of modules of contacts typically, which are electrical and/or optical depending on the electrical and/or optical connection to be achieved. A high current and/or a high electrical can be transmitted by this system.

This connection system may also accommodate contacts or modules for high speed electrical network applications, particularly for typical network applications like 100 Mbit/s Ethernet, Gigabit Ethernet. IEEE 1394, Fibre Channel, quadrax . . .

Each contact or module of contacts can be considered as a single independent connector inside the connection system, which can be separately assembled when already shielded and completed by its strain relief.

More generally, the connection system according the invention can be applied to any types of electrical and/or optical connections.

Figure 1:
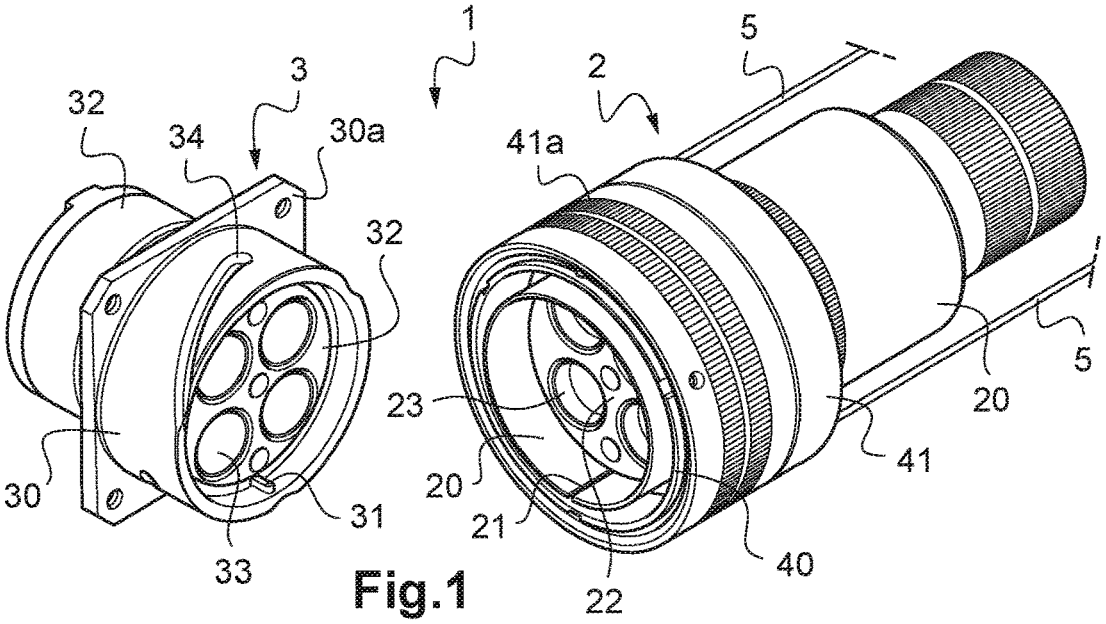
FIG. 1 is a perspective view respectively of a plug and a receptacle of a connection system according to the invention, the plug and the receptacle being not in mutual connection and locking configuration.

FIG. 1 represents an example of a connection system 1 of a circular cross-section, according to the invention.

This connection system 1 comprises, respectively, a plug 2, a receptacle 3 and a manual locking device 4 suitable for mechanically locking the plug 2 to the receptacle 3 when they are in mutual connection configuration.

The plug 2 comprises a cylindrical body 20 which includes a front through slot 21. This slot 21 forms the female part of a polarizing system between the plug 2 and the receptacle 3. The cylindrical body 20 is made preferably of an electrical conductive material, but may be made of an insulating material.

The plug 2 comprises also an insert 22. This insert 22 may be made of an insulating material, but it may also be metallic in case of optical contacts or shielded quadrax contacts for example. The insert 22 includes one or a plurality of cells 23 each forming a housing for an electrical or an optical connection module or contact not shown. Each cell can be coded and identified by suitable markings over the insert 22. For a precise and reliable positioning, each module or contact may have its own guiding system inside the insert 22.

The receptacle 3 comprises also a cylindrical body 30 which includes a front rib 31. This rib 3 is complementary to the through slot 21 and thus forms the male part of the polarizing system between the plug 2 and the receptacle 3. The cylindrical body 30 is made preferably in an electrical conductive material, but may be made of an insulating material.

The cylindrical body 30 has at the periphery of its circular cross-section a flange portion 30*a*, which allows the receptacle 3 to be mounted on a panel, such as a control panel of instruments or on another wall of an assembly.

The receptacle 3 comprises also an electrical insert 32. This insert 32 made of an insulating material, but it may also be metallic in case of optical contacts or shielded quadrax contacts for example. The insert 32 includes one or a plurality of cells 33, each forming a housing for an electrical or an optical contact or module not shown which is complementary to one module or contact housed in a cell 23 of the plug 2. As for the plug 2, each cell can be coded and identified by suitable markings over the insert 32, and cell may have its own guiding system inside the insert 32.

The periphery of the body 30 is provided with one or more locking inclined helical grooves or ramps 34. Preferably, as shown in the illustrated embodiment, three identical ramps 34 are distributed at 120° relative to one another.

According to the invention, the manual locking device 4 for locking the plug 2 to the receptacle 3 when they are in a configuration of a mutual connection is a bayonet-type device.

The device 4 comprises firstly a locking nut comprising two cooperating parts, the internal shell 40 and the external shell 41. The nut is mounted free in rotation around the body 200 of the plug 2. The external shell 41 is adapted to move in translation along said body 20 but only on a limited course.

The locking nut comprises an internal cylindrical shell 40 adapted for accommodating the cylindrical body 20 of the plug 2. This internal shell 40 comprises one or more locking pins 42, each of which being protruding inwardly through an opening 43 made into the shell 40. Preferably, as shown in the illustrated embodiment, three locking pins 42 are distributed at 120° relative to one another.

Each of the locking pin 42 is fixed to the internal shell 40 by the intermediate of a plate flexible band or a flexible strip 44, which one end is secured to the locking pin 42 whereas the other end is retained by a screw 45 screwed into the internal shell 40. Each of the flexible strip 44 may be constituted by a metallic material.

Advantageously, as shown in the illustrated embodiments, a supplemental pin 46, which is mounted into the internal shell 40, allows to maintain each flexible strip 44 along the longitudinal axis of the plug 2, whatever the forces applied on the locking pin 42.

In other words, this holding pin 46 allows the strip 44 not to rotate laterally with regard to the longitudinal axis of the plug 2, when a pull force is applied on the external shell 41 of the locking nut, as detailed herein after.

This external shell 41 is mounted around the internal shell 40 and includes a gripping zone 41*a* which is suitable for manual gripping.

An attachment flange 47 is attached to the inside of the external shell 41. As shown in the illustrated embodiment, the flange 47 may be a circular plate arranged transversally to the longitudinal axis of the plug 2.

A pull element 5, which function will be detailed hereinafter, is arranged outside the plug 2 and attached to the attachment flange 47. The pull element 5 may be flexible and formed by a lanyard or a cable, or rigid under the form of a bar or a rod or a cord or any rigid piece. As shown in the illustrated embodiments, the pull element 5 may consist into a unique piece with both ends attached to the attachment element 47 or may be divided into two strands both attached to the attachment element 47. A handle may be arranged on the pull element 5 for facilitating a manual gripping.

Figure 3A:
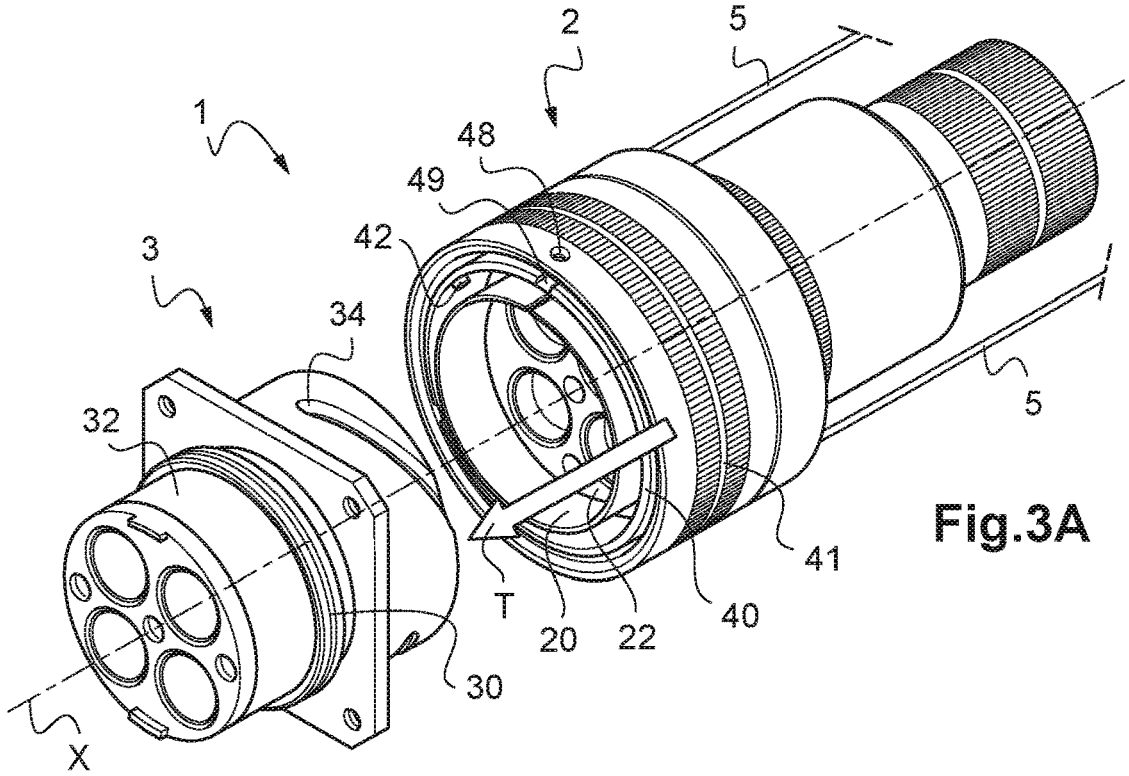
FIG. 3A is a perspective view of the plug and the receptacle of FIG. 1 before their mutual connection along the longitudinal axis X of the connection system.

The external shell 41 is mounted sliding around the internal shell 40 on a predetermined course. As shown in FIG. 3A, the sliding mounting is achieved by a guiding pin 48 attached in the front part of the external shell 41 which can slide into the guiding groove 49 provided in the front part of the internal shell 40.

The sliding mounting is such that:

when a pull force is applied on the external shell 41 in the direction P opposite to the connection direction C, i.e. a force applied from the front part of the plug 2 towards the rear part, while the internal shell 40 is blocked, the external shell 41 can slide over the internal shell 40;

when no pull force is applied on the external shell 41, the two shells 40, 41 are mechanically coupled such that a rotating force on said external shell 41 drives in the same rotation the internal shell 40.

Figure 2:
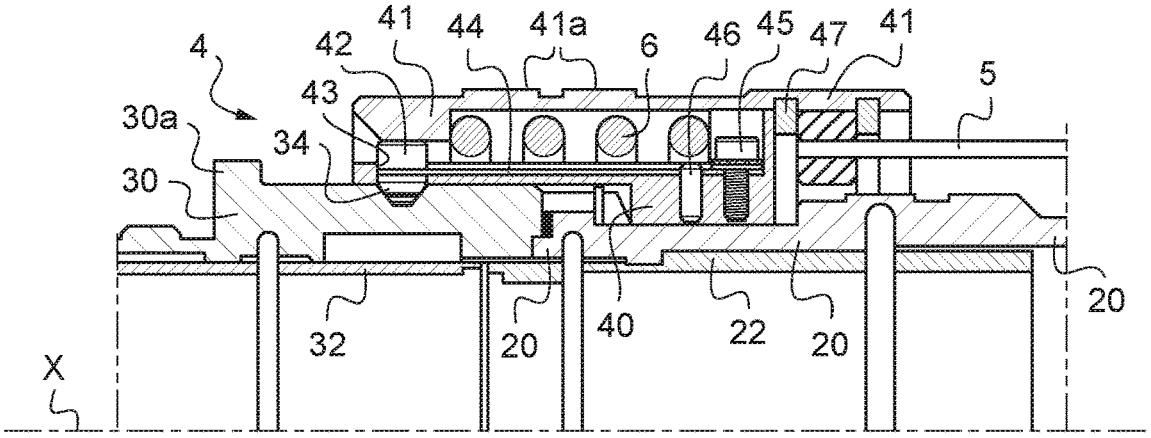
FIG. 2 is a semi-longitudinal cross-sectional view of a connection system according to the invention, the plug and the receptacle being in mutual connection and locking configuration.
Figure 2A:
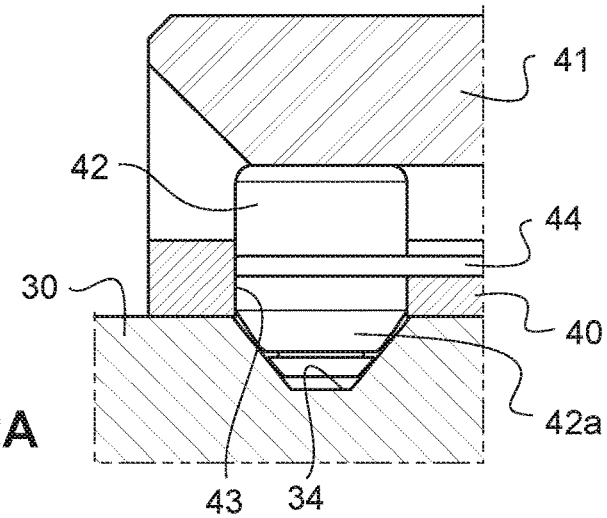
FIG. 2A is a detailed view of FIG. 2 showing the cooperation between a locking pin and a locking ramp of the bayonet-type locking device according to the invention.

Advantageously, the shape of a locking pin 42 and the complementary locking ramp 34 allows a disengagement of the pin 42 transversally from the ramp 34 when a traction is exerted on the plug 2, as explained hereinafter. As shown on FIG. 2A, a preferred variant consists in a cross-section of the lower portion 42*a* of the at least one locking pin 42 which is of a truncated cone shape and is complementary to the truncated cone shape of the cross-section of the locking ramp 34.

Advantageously, at least one spring forming element 6 is arranged between the internal shell 40 and the external shell 41. This spring element 6 is adapted to push the external shell 41 back to its position surrounding the at least one locking pin 42, when no pull force is applied on said external shell 41. As shown on FIG. 2, the spring forming element 6 is a compression helical spring which one free end is abutment against the internal front part of the external shell 41 and the other free end is in abutment against the external rear part of the internal shell 40. The spring forming element 6 may be in a metallic material.

The different manual steps of operation of the connection system 1 with the locking bayonet-type device 4 will now be explained with reference to FIGS. 3A through 7C.

For achieving the mutual connection between the plug 2 and the receptacle 3, as shown on FIG. 3A, they are joined together by approaching the plug 2 towards the receptacle 3 with a translation force according to the arrow T. During this step, each of the locking pin 42 slides along a locking ramp 34 of the receptacle 3

Figure 3B:
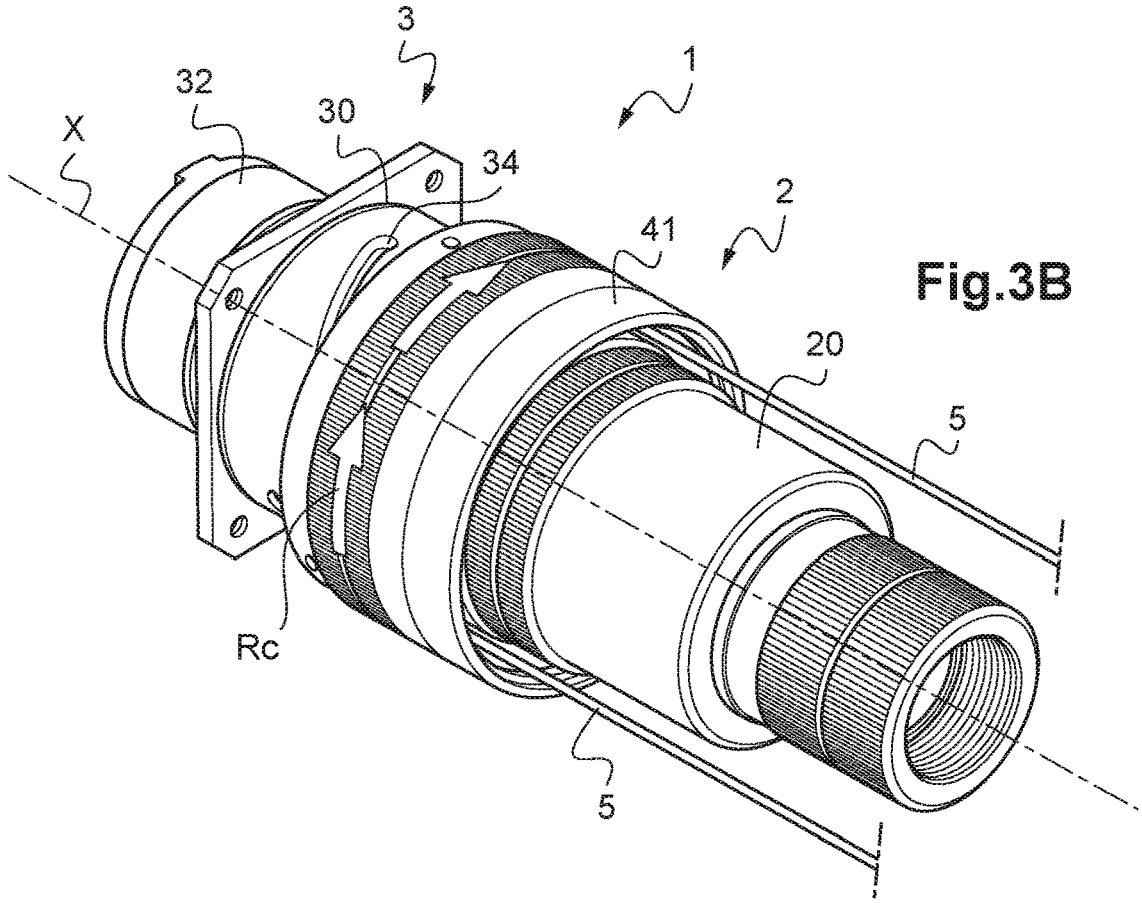
FIG. 3B is a perspective view of the plug and the receptacle of FIG. 1 once their mutual connection along the longitudinal axis X has been achieved and before that their locking configuration is achieved due to the rotation of the locking nut in a clockwise sense.

Once the plug 2 is mutually connected to the receptacle 3, as shown on FIG. 3B, the locking operation consists on rotating the locking nut 40, 41 around the body 30 of the receptacle 3 around the axis X, in the clockwise sense, i.e. according to the arrow Rc, until the limit stop is reached to produce the complete locking. During this rotation of the locking nut 40, 41, each of the locking pin 42 slides at the extremity of the locking ramp 34 of the receptacle 3 which allows the mechanical locking between the plug 2 and the receptacle 3.

Figure 4:
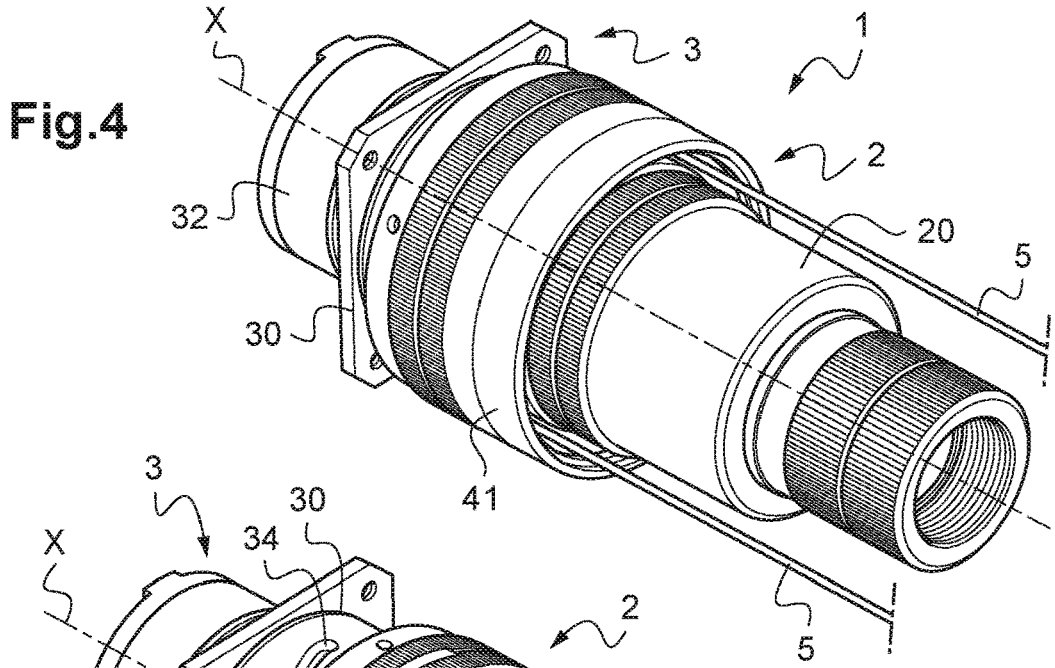
FIG. 4 is a perspective view of the plug and the receptacle of the system of FIG. 1 in mutual connection along the longitudinal axis X and in a locking configuration.

FIG. 4 shows the mutual connection and the locking configuration which are obtained between the plug 2 and the receptacle 3.

Figure 5:
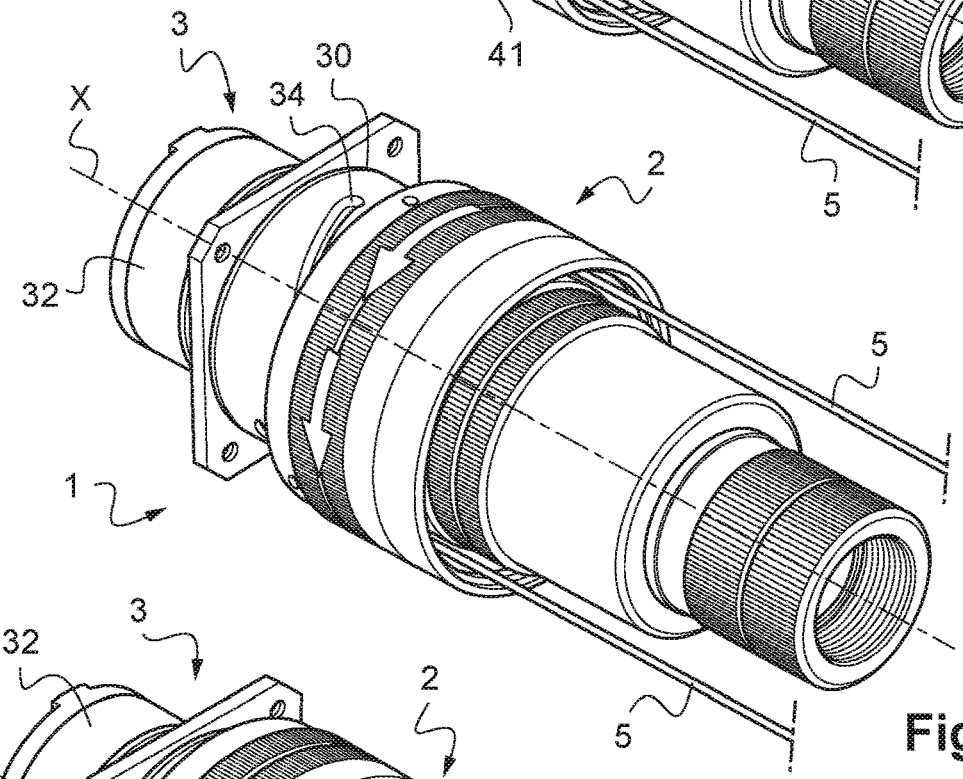
FIG. 5 is a perspective view of the plug and the receptacle of FIG. 1 in their mutual connection and before that their unlocking configuration is achieved due to the rotation of the locking nut in the anti-clockwise sense.

FIG. 5 shows an unlocking operation in normal conditions, i.e. where a fast unlocking is not required. This normal unlocking is achieved by rotating the locking nut 40, 41 in the anti-clockwise sense, according to the arrow $R_U$ until the nut 40, 41 is mechanically disengaged from the body 30 of the receptacle 3 due to the sliding of the locking pin 42 in the locking ramps 34 up to the exit from these ramps 34.

Figure 6:
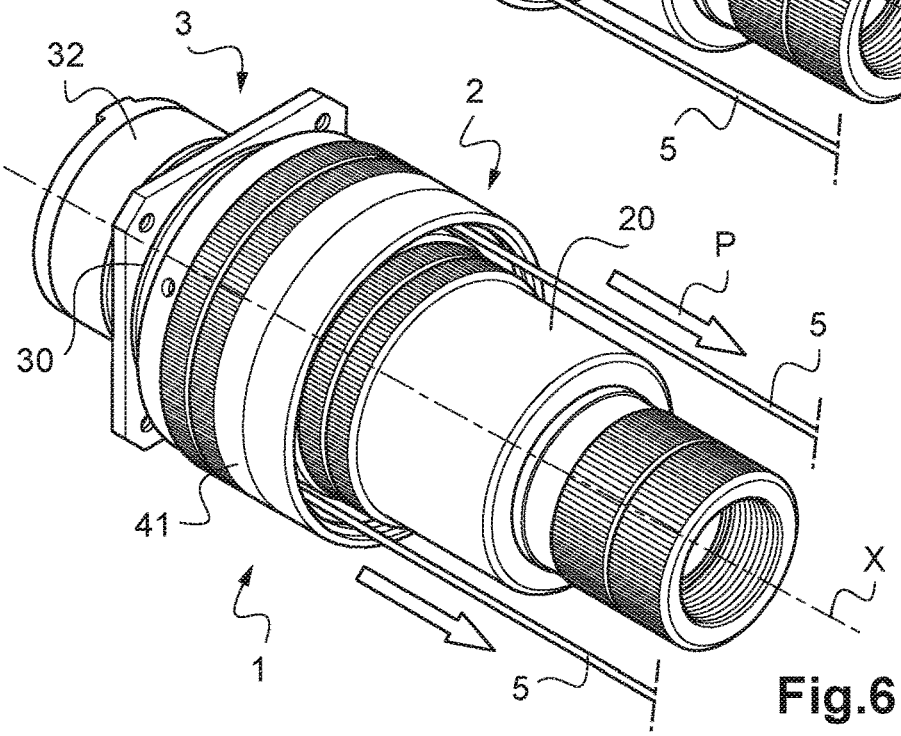
FIG. 6 is a perspective view of the plug and the receptacle of FIG. 1 in their mutual connection and before that their fast unlocking configuration is achieved due to the pull force applied to the locking nut by the intermediate of an outer pull element.

A fast unlocking operation is represented on FIG. 6: a pull force is applied on the cable or lanyard 5 according to the arrow P, which makes the external shell 41 of the locking nut slide backward. i.e. towards to the rear part of the plug 2, due to the link with the attachment flange 47.

Figure 7A:
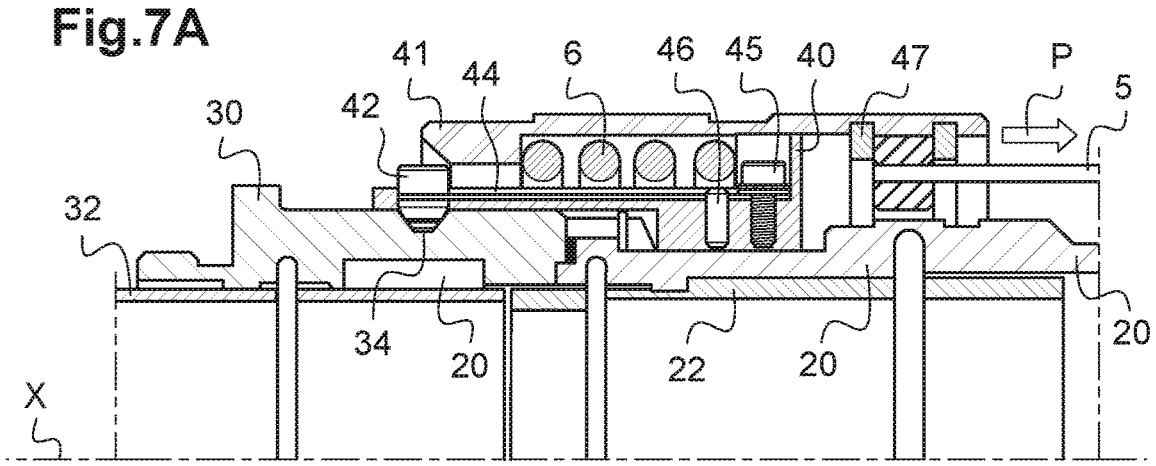
FIGS. 7A to 7C are semi-longitudinal cross-sectional views of a connection system according to the invention, showing the different steps of the fast decoupling between the plug and the receptacle with, firstly a fast unlocking step and then with a disconnection step due to the pull force applied on the locking nut.

At the beginning of the pull force according to the arrow P, the external shell 41 which is sliding backward will release the top of the locking pins 42 (FIG. 7A).

Deprived of this external mechanical barrier achieved by the external shell 41, the locking pins 42 are disengaged from the ramps 34 because of the relative translation between the body 30 of the receptacle 3 and the inner shell 40 of the plug 2 under the action of the pull force.

Indeed, the pull force first makes sliding backward the external shell 41 and then is transmitted to the inner shell 40 and from there to the plug 2.

Figure 7B:
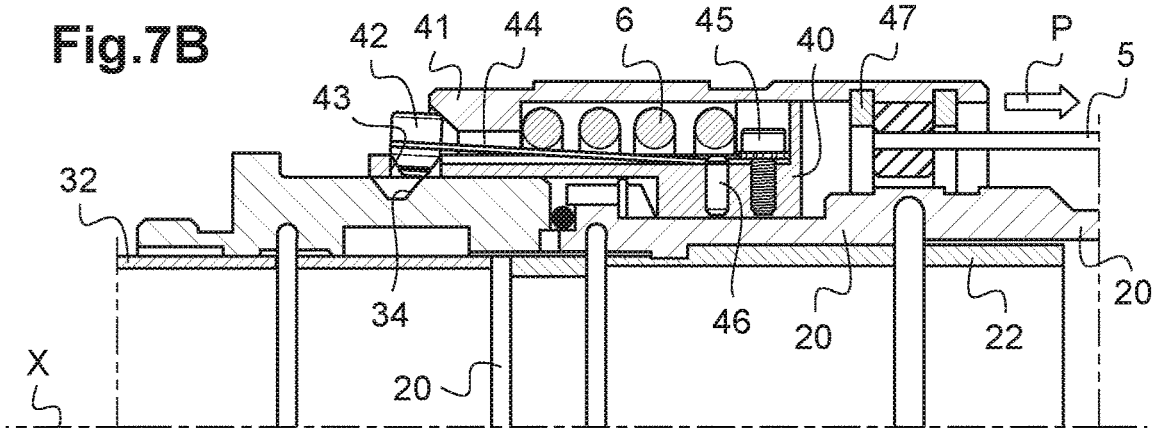

The force applied to the plug 2 tends to separate it from the receptacle 3. Each pin 42 resists to it, but due to the truncated conic shape moves radially until it is disengaged from the ramp 34. In other words, the disengagement of the pin 42 is facilitated by the truncated cone shapes of both the pins 42 and the ramps 34 (FIG. 7B).

Figure 7C:
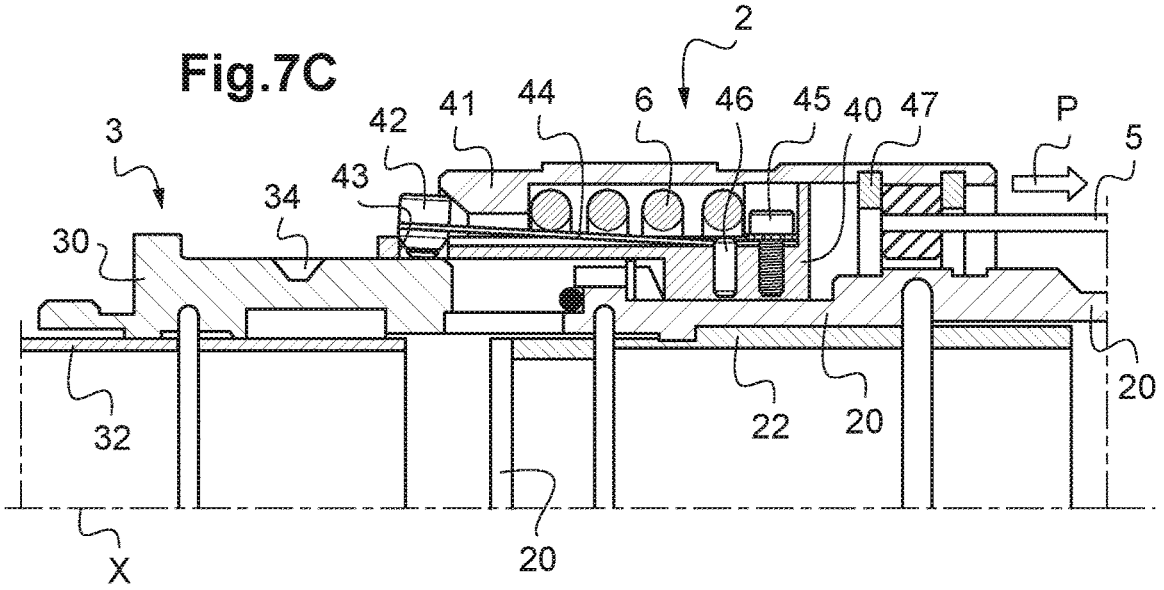

Continuing to apply the pull force, this allows to disengage completely the locking pins 2 from any ramp 34, which is unlocked the plug 2 from the receptacle 3 and after the full disconnection between them (FIG. 7C).

When the full disconnection is achieved and then the plug 2 far from the receptacle 3, no pull force is applied on the external shell 41. In this configuration, the spring force of the spring element 6 brings the external shell 41 back to its original position surrounding the locking pins 42 which are received in the corresponding openings 43 of the internal shell 40.

The plug 2 is thus ready to be connected and locked once again together with the receptacle 3.

The flexible strip 44 acts as an holder designed in order to allow the disengagement of the locking pin 42 from the locking ramp 34 during the pulling step and to allow the repositioning of the locking pin 42 in the corresponding openings 43 of the internal shell 40 at the end of the pulling step.

If in the shown embodiments, the locking nut 40, 41 is mounted free in rotation around the plug 2, it can be also envisaged to achieve this mounting around the receptacle 3, the locking ramps 34 being then provided around the periphery of the body 20 of the plug 2.

Although, in the embodiments illustrated, the shape of the locking pins 42 and ramps 34 is a truncated cone shape, any outwardly flared shape which ensures the disengagement of the pin 42 transversally to the ramp 34 may be foreseen.

Other variants and enhancements can be provided without in any way departing from the framework of the invention.

The expression "comprising a" should be understood to be synonymous with "comprising at least one", unless otherwise specified.

The invention claimed is:

1. A connection system of longitudinal axis X, comprising:

a first system element forming a plug and a second system element forming a receptacle, a bayonet-type locking device comprising:

a locking nut mounted at least free in rotation around one of among the plug and the receptacle, at least one locking pin being arranged into the locking nut, said at least one locking pin being adapted to be engaged into a locking ramp provided in one of among the receptacle and the plug by relative translation between the plug and the receptacle and rotation of the locking nut so as to mechanically lock the plug to the receptacle when they are in mutual connection along the longitudinal axis X, wherein the arrangement of the said at least one locking pin being such that a pull force (P) applied to a sliding part of the locking nut, in a sense opposite to the sense of their mutual connection along the longitudinal axis X, disengages the said at least one locking pin from the locking ramp, thereby allowing the unlocking of the plug from the receptacle, then their mutual disconnection;

wherein the locking nut comprises an internal shell and an external shell which is sliding mounted around the internal shell on a predetermined course, wherein the at least one locking pin is mounted into an opening of the internal shell and attached to the free end of a flexible strip, the other end of the flexible strip being attached to the internal shell, the external shell surrounding the at least one locking pin in their mutual connection and locking configuration.

2. A connection system according to claim 1, wherein the cross-section of the lower portion of the at least one locking pin is of a truncated cone shape and is complementary to the truncated cone shape of the cross-section of the locking ramp.

3. A connection system according to claim 1, comprising three locking pins distributed at 120° relative to one another on the periphery of the locking nut, and wherein the body of the one among the plug and the receptacle comprises three locking ramps of the same shape distributed at 120° relative to one another, any of the locking pins being suitable for cooperating with any of the ramps.

4. A connection system according to claim 1, comprising at least one holding pin which is mounted into the internal shell, said holding pin being adapted to maintain each flexible strip along the longitudinal axis of the plug.

5. A connection system according to claim 1, comprising at least one spring forming element arranged between the internal shell and the external shell, said spring element being adapted to push the external shell back to its position surrounding the at least one locking pin, when no pull force is applied on said external shell.

6. A connection system according to claim 5, wherein the spring forming element is a compression helical spring.

7. A connection system according to claim 1, comprising at least one an attachment flange which is attached to the sliding part of the locking nut, and a pull element attached to the attachment flange and arranged outside the locking nut in order to be accessible from the outside of the connection system.

8. A connection system according to claim 7, comprising two attachment flanges and a flexible pull element, each end of which is attached to one attachment flange.

9. A connection system according to claim 1, wherein the locking nut is mounted free in rotation around the body of the plug, while the locking ramp(s) being provided at the periphery of the body of the receptacle.

10. A connection system according to claim 1, constituting a connection system comprising a plug and a receptacle, each having an insert including a plurality of cells each forming a housing for an electrical or an optical contact or contacts module.

11. A method of quick disconnecting the connection system according to claim 1, comprising the following step:

applying a pull force backward on the external shell on a predetermined course making this latter sliding along the internal shell on the predetermined course, thereby allowing firstly the disengagement of the external shell from the top of the at least one locking pin, and after the disengagement of said pin from the locking ramp by the relative translation of the plug and the receptacle.

* * * * *